US007305912B2

(12) United States Patent
Goldstein et al.

(10) Patent No.: US 7,305,912 B2
(45) Date of Patent: Dec. 11, 2007

(54) CHEMICALLY DRIVEN HYDROGEN GUN

(75) Inventors: Shyke Goldstein, Gaithersburg, MD (US); Michael Raleigh, Alexandria, VA (US); Michael Bohnet, Herndon, VA (US); James Galambos, Alexandria, VA (US); Mark Machina, Alexandria, VA (US)

(73) Assignee: BAE Systems Advanced Technologies, Inc., Nashua, NH (US)

( * ) Notice: Subject to any disclaimer, the term of this patent is extended or adjusted under 35 U.S.C. 154(b) by 84 days.

(21) Appl. No.: 11/027,755

(22) Filed: Dec. 30, 2004

(65) Prior Publication Data

US 2006/0144214 A1 Jul. 6, 2006

(51) Int. Cl.
*F41F 1/00* (2006.01)

(52) U.S. Cl. ..... 89/9; 89/8

(58) Field of Classification Search ..... 89/7, 89/8, 9; 102/374–378

See application file for complete search history.

(56) References Cited

U.S. PATENT DOCUMENTS 2,413,324 A * 12/1946 Hans ..... 55/452
3,204,696 A * 9/1965 De Preister et al. ..... 166/59
3,813,854 A * 6/1974 Hortman ..... 55/399
4,281,582 A * 8/1981 Jaqua ..... 89/7
4,841,834 A * 6/1989 Gruden ..... 89/8
4,953,440 A * 9/1990 Moscrip ..... 89/7
4,974,487 A 12/1990 Goldstein et al.
5,012,719 A 5/1991 Goldstein et al.
5,052,272 A * 10/1991 Lee ..... 89/7
5,072,647 A 12/1991 Goldstein et al.
5,143,047 A * 9/1992 Lee ..... 126/263.05
5,235,894 A * 8/1993 Nitschke et al. ..... 89/8
5,531,811 A * 7/1996 Kloberdanz ..... 95/261
5,549,046 A 8/1996 Widner et al.
5,612,506 A 3/1997 Goldstein
5,904,042 A * 5/1999 Rohrbaugh ..... 60/298
5,909,001 A 6/1999 Goldstein
5,945,623 A 8/1999 Goldstein et al.
6,800,258 B2 * 10/2004 Andersen et al. ..... 422/211

* cited by examiner

*Primary Examiner*—Troy Chambers
(74) *Attorney, Agent, or Firm*—Rossi, Kimms & McDowell LLP

(57) ABSTRACT

An electrothermal gun uses an apparatus for generating high gas pressure. The apparatus includes a receiver having a combustion chamber for holding a propellant which produces a gas component and a particle component when the propellant undergoes an exothermic chemical reaction, and a flow passageway positioned downstream of the combustion chamber. An ignition mechanism causes the propellant contained in the combustion chamber to undergo the exothermic chemical reaction. A separator in the flow passageway substantially separates the particle component from the gas component in the flow passageway. The gun includes a barrel connected to the receiver and communicating with the flow passageway. By substantially stopping the particle component, namely metal oxide, from reaching the barrel, wear on the barrel is reduced.

10 Claims, 3 Drawing Sheets

CHEMICALLY DRIVEN HYDROGEN GUN

BACKGROUND

Electrothermal guns that use inert, safe-to-handle, propellants have been contemplated. See for example, U.S. Pat. Nos. 5,549,046; 5,072,647; 5,012,719; 4,974,487, the disclosures of which are incorporated herein by reference, which describe the use of a high pressure gas pulse to propel a projectile or projectiles out of a gun barrel. A source of gas is obtained by combusting an inert safe-to-handle propellant. The propellant is typically composed of a fuel, namely a metal hydride or metal, such as aluminum powder, and an oxidizer, namely water or a water-hydrogen peroxide mixture. Combusting a slurry of metal powder and water in a closed chamber generates high pressure gas, namely hydrogen gas, and a metal oxide aerosol. The apparatus and method for combusting such a propellant is well known, namely applying a high pulsed voltage through an electrode to produce an electrical discharge or plasma, which changes water to steam and vaporizes the metal powder in an exothermic chemical reaction, forming hydrogen gas and metal oxide particles aerosol.

Inert propellants are highly desirable since they are difficult to combust, making them safer to manufacture and handle. While the hydrogen gas component is useful for propelling a projectile or projectiles out of a barrel, the metal oxide aerosol component is undesirable, due to a tendency of the metal oxide aerosol to erode the barrel of the gun and to decrease the overall efficiency of the process. Accordingly, it would be desirable to provide a mechanism for separating the metal oxide aerosol component from the hydrogen gas component that results upon combustion of the propellant. Separation of the two combustion components would result in increased barrel life and an increase in the overall efficiency of the combustion process.

SUMMARY OF THE INVENTION

The present invention relates to an apparatus for generating high pressure gas pulse using a propellant, an electrothermal gun incorporating the pressure generating apparatus, and an apparatus and method for reducing wear thereof.

One aspect of the present invention is an apparatus for generating high pressure gas pulse. The apparatus includes a receiver having a combustion chamber for holding a propellant, which produces a gas component and a particle component when it is heated to undergo an exothermic chemical reaction, and a flow passageway positioned downstream of the combustion chamber, an ignition mechanism for igniting the propellant in the combustion chamber, and a separator for substantially separating the particle component from the gas component in the flow passageway.

The propellant can be composed of a slurry of aluminum powder and water. The exothermic chemical reaction of the slurry produces hydrogen gas and aluminum oxide particles.

The separator can include at least one gas passageway having a length sufficient to allow the gas component to stay in front of the particle component and move out of the separator, and deflecting the particle component to substantially remain inside the separator.

In one embodiment, the separator can include a plurality of spaced disks arranged in the flow passageway, with each spaced disk including at least one through hole. Specifically, the spaced disks can include at least one first disk having a central through hole and at least one second disk having a plurality of through holes positioned adjacent to the periphery thereof. The central through hole can be larger than each of the through holes formed in the second disk.

In other embodiments, the separator can include at least a first set of spirally or cyclonically curved fins to swirl and apply a centrifugal force on the gas and particle components. The separator can further include a plurality of annular pockets formed around the periphery of the flow passageway for trapping the particle component. The first set of fins can extend substantially the entire axial length of the flow passageway, and can include a shroud that extends around the outer periphery of the fins at a distal end portion thereof to form a plurality of discrete flow paths, one for each adjacent pairs of fins. Alternatively, the separator can further include a second set of spirally or cyclonically curved fins spaced from and positioned downstream of the first set of fins, and an intermediary planar member connecting the first and second sets of fins. The planar member can substantially divide the flow passageway extending between the first and second set of fins into two zones.

Another aspect of the present invention is an electrothermal gun that incorporates the apparatus for generating high pressure gas mentioned above, with a barrel connected to the receiver and communicating with the flow passageway.

Another aspect of the present invention is a method of reducing wear in the electrothermal gun mentioned above by providing a flow passageway positioned between the combustion chamber and the barrel, and separating the particle component from the gas component in the flow passageway so that a substantial portion of the particle component is stopped from being introduced into the barrel.

The particle component can be substantially separated from the gas component by providing at least one gas passageway having a length sufficient to allow the gas component to stay in front of the particle component and move out of the separator, and deflecting the particle component to remain inside the separator. Specifically, the particle component can be substantially separated from the gas component by directing the gas and particle components through undulating labyrinth flow paths to disrupt and deflect the particle component, while allowing the gas component to readily flow through the labyrinth flow paths. Alternatively, the particle component can be substantially separated from the gas component by causing the gas and particle components to swirl and apply a centrifugal force on the gas and particle components. A plurality of annular pockets can be formed around the periphery of the flow chamber to trap the particle component.

BRIEF DESCRIPTION OF THE DRAWINGS

With the above as background, the invention will now be described with reference to certain preferred embodiments thereof, wherein.

DETAILED DESCRIPTION OF THE PREFERRED EMBODIMENTS

Figure 1:
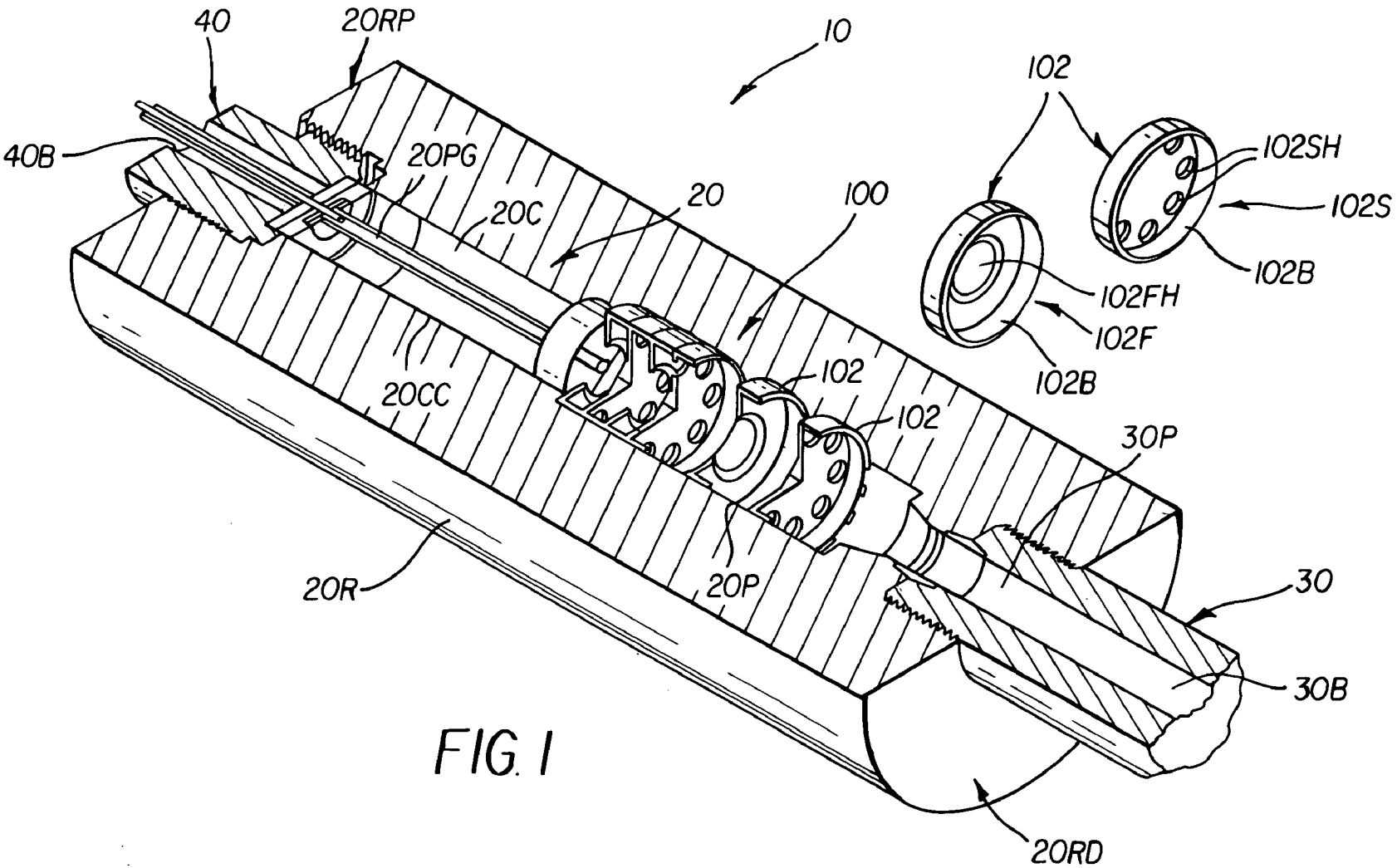
FIG. 1 illustrates a cross-sectional view of one embodiment of an electrothermal gun according to the present invention.
Figure 2:
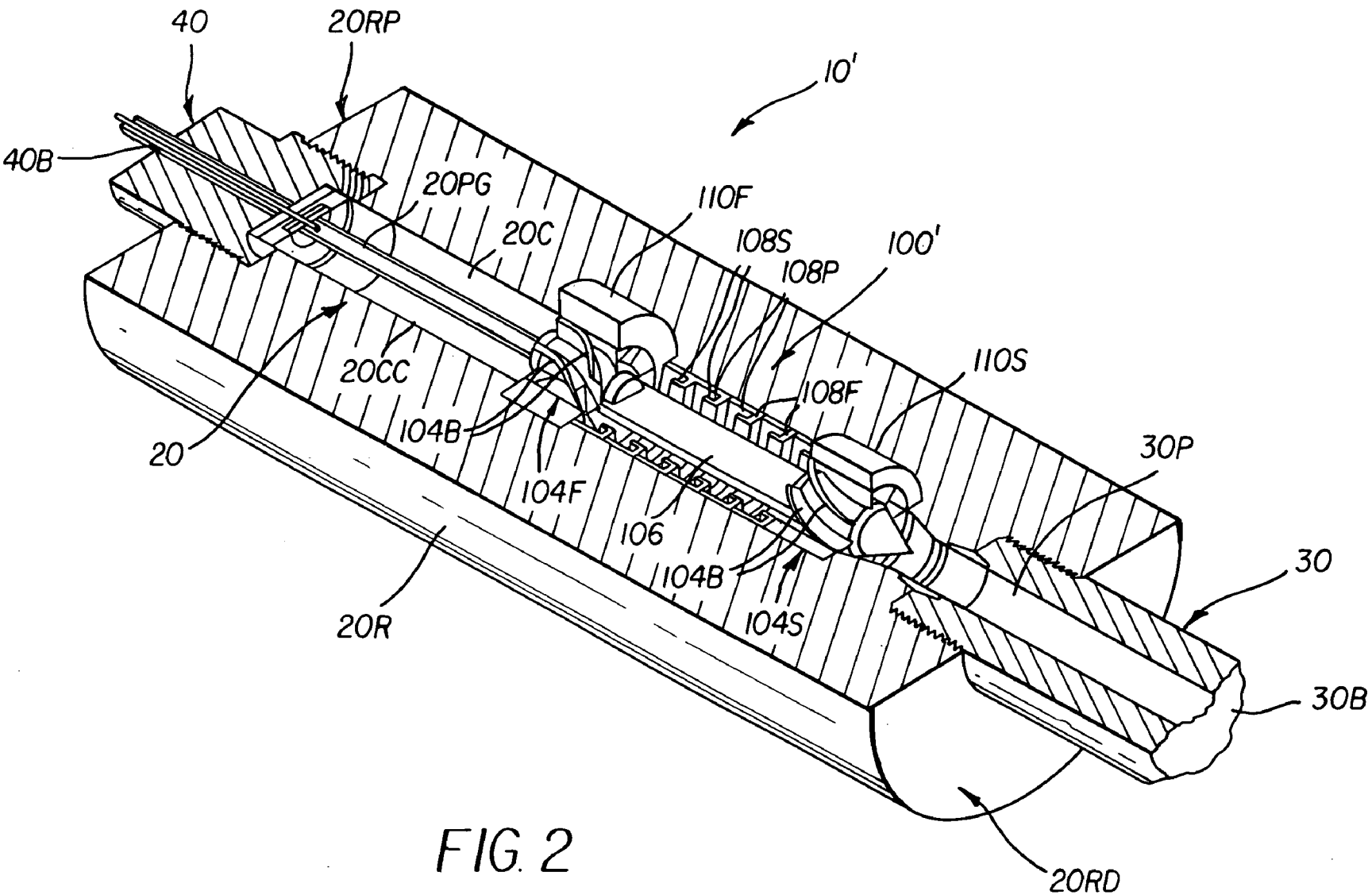
FIG. 2 illustrates a cross-sectional view of another embodiment of an electrothermal gun according to the present invention.
Figure 3:
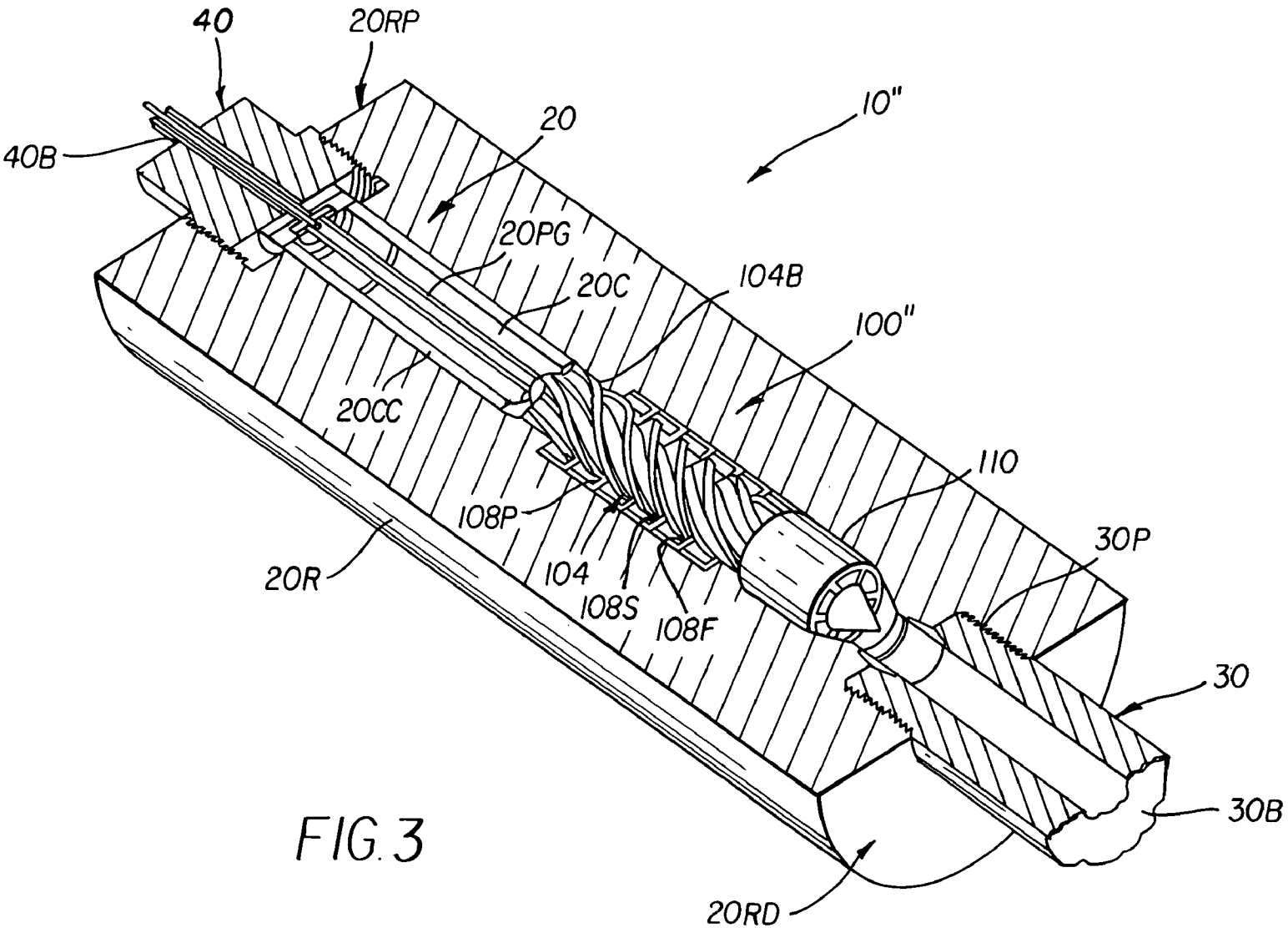
FIG. 3 illustrates a cross-sectional view of yet another embodiment of an electrothermal gun according to the present invention.

FIGS. 1-3 illustrate an electrothermally triggered gun 10, 10', 10", which includes an apparatus 20 for generating high pressure gas and a barrel 30 positioned downstream of the pressure generating apparatus 2, and a separator or separating means 100, 100', 100" positioned between the barrel and the pressure generating apparatus. The pressure generating apparatus 20 includes a receiver 20R, which can be any strong body made of material, such as high strength metal alloys, capable of withstanding high pressure and heat associated with combusting a propellant under an exothermic chemical reaction.

The receiver 20R includes a combustion chamber 20C for receiving and combusting a propellant, and a passageway 20P extending downstream of the combustion chamber 20C for directing the combusted propellant components out of the combustion chamber 20C and into the barrel 30. In the illustrated embodiments, the barrel 30 is threaded into a distal end side 20RD of the receiver 20R, with the passageway 20P axially aligned with a bore 30B of the barrel 30, and the combustion chamber 20C is accessed from the proximal end side of the receiver 20R.

In the illustrated embodiments, the combustion chamber 20C is configured to hold or seat a sealed cartridge casing 20CC containing a propellant and an ignition mechanism comprising a plasma generator 20PG. The cartridge casing 20CC is inserted into the combustion chamber 20C from the proximal end side 20RP of the receiver 20R and immobilized with an end cap 40, which can be threaded into the proximal end side, or otherwise held in there securely. The cap 40 has a bore 40B to permit the plasma generator 20PG to access an external power source (not illustrated).

The plasma generator 20PG can be constructed as described in the U.S. patents mentioned above, the disclosures of which are incorporated herein by reference, or known plasma generator. For example, a plasma generator, as disclosed in U.S. Pat. No. 5,549,046, can be placed axially inside the cartridge casing 20CC, while extending one end out the cartridge to access a power source, such as a pulsed energy source. When a large pulsed electrical energy (in the order of several kilovolts and 100 kiloamps) is applied to the plasma generator 20PG, the large current flow produces relatively large electromagnetic forces, as well as substantial forces due to electrical arcing, which generates a plasma.

The propellant can be composed of a slurry of aluminum powder and water, for example. When the cartridge casing 20CC containing such a propellant is combusted with the plasma generator to undergo an exothermic chemical reaction, the propellant is converted to hydrogen gas, and aluminum oxide suspended in hydrogen gas. One or more projectiles (not illustrated) can be situated in the proximal end portion 30P of the barrel bore 30B, essentially blocking the passageway 20P from the ambient to allow pressure to build up behind the projectile upon combusting the propellant. Hydrogen gas, having the lightest molecule, reaches the projectile before aluminum oxide particles or vapors. In other words, the greater mobility of the lighter hydrogen molecule causes hydrogen gas to move faster than the heavier aluminum oxide particles, creating a stratified flow.

As previously mentioned, the aluminum oxide particles abrade and wear down the gun components, particularly the barrel. Barrel wear is significantly improved by separating and preventing destructive metal oxide component from reaching the barrel. FIGS. 1-3 illustrate various means or separators 100, 100', 100" for separating the metal oxide component from the hydrogen gas component, namely using a labyrinth flow path (FIG. 1) or a cyclonic flow path (FIGS. 2 and 3). In each embodiment, separating means or separators include at least one gas passageway. The passageway allows the hydrogen gas component, which is lighter in mass than the metal oxide component, to travel ahead of the particle component, and deflecting the lagging metal oxide component away from the barrel. This can be achieved by increasing the flow path length sufficient to allow the faster moving hydrogen gas component to reach and drive the projectile, while deflecting the slower moving metal oxide component away from the barrel. This allows only the lighter, faster performing hydrogen gas to work on the projectile.

In the embodiment of FIG. 1, the separating means or separator 100 comprises a plurality of spaced disks 102. Specifically, the disks 102 include a first disk 102F and a second disk 102S, which are alternately arranged in a flow passageway 20P formed in the receiver 20R downstream of and communicating with the combustion chamber 20CC, and with the disk side perpendicular to the axial direction of the flow passageway 20P. The first disks 102F each have a central through hole 102FH while the second disks 102S each have a plurality of smaller through holes 102SH adjacent to the periphery thereof. In the illustrated embodiment, the second disks 102S each have 8 holes, but additional or fewer holes can be provided. The central through holes 102FH is larger than the through holes 102SH. The dimensions of the holes may vary depending on the type of propellant utilized and the resulting size of the oxide particles. Each of the disks 102 also has an integrated spacer, which can be an annular ring or band 102B that extends axially along its periphery. When the first and second disks are stacked together alternately in the flow passageway 20P, the gas flow paths deviate with each passing of the disks. In other words, the gas must pass through the undulating labyrinth flow paths created by differently sized and positioned holes, disrupting and deflecting the slower moving metal oxide component that cannot readily change directions to pass through the holes, while the lighter and much more mobile hydrogen gas component can readily flow through the labyrinth flow paths to propel the projectile. The labyrinth configuration of the holes in the disks deflects the slower moving metal oxide component so that the metal oxide-component substantially does not reach the barrel.

In the embodiment of FIG. 2, the separating means or separator 100' comprises a first set 104F of fins and a second set 104S of fins spaced downstream of the first fin set 104F. The first and second fin sets 104F, 104S are connected to each other with an intermediary planar member 106 that substantially divides the flow passageway 20P into two zones. A plurality of spaced first annular rings 108F facing perpendicular to the axial direction of the flow passageway 20P are positioned between the first and second fin sets 104F, 104S and surrounding the intermediary planar member 106. A second annular ring 108S extends axially of the flow passageway from the inner periphery of each first annular ring 108F. The first and second annular rings 108F, 108S form an annular pocket 108P for trapping the metal oxide component. Each of the first and second fin sets 104F, 104S include a plurality spirally or cyclonically curved fins or blades 104B. A shroud 104F, 110S extends around the outer periphery of each of the first and second fin sets 104F, 104S to form a plurality of discrete flow paths, one for each adjacent pairs of fins 104B. The fins 104B of the first set 104F causes combusted propellant components to flow spirally or swirl to generate a centrifugal force. The faster and more mobile hydrogen gas component, which is moving in front of the slower and heavier metal oxide component, swirls about the intermediary planar member and the first and second annular rings 108F, 108S and readily exits through the second fin set 104S. The centrifugal force acting on the metal oxide component having heavier mass drives the metal oxide component radially outwardly toward the chamber wall, where the annular pockets 108P can trap the same. The metal oxide component that is not trapped by pockets 108P is deflected off the proximal end side of the second shroud 110S.

The embodiment of FIG. 3 operates similar to the second embodiment. Specifically, the separating means or separator 100" comprises a set of fins 104 that extend substantially the entire axial length of the flow passageway 20P, instead of the spaced sets of fins. Again, a plurality of spaced first and second annular rings 108F, 108S extend around the fin set 104. The distal end portion of the fin set 104 includes a shroud 110 that extends around the outer periphery of the spirally or cyclonically curved fins or blades 104B to form a plurality of discrete flow paths, one for each adjacent pairs of blades 104B. The blades 104B cause the combusted propellant components to flow spirally, generating a centrifugal force. The faster and light hydrogen gas component, which is moving in front of the slower and heavier metal oxide component, swirls and readily exits through the discrete flow paths formed by the shroud 110. The centrifugal force acting on the metal oxide component, due to larger mass, drives the metal oxide component radially outwardly toward the chamber wall, where the annular pockets 108P can trap the same. The metal oxide component that is not trapped by pockets 108P is deflected off the proximal end side of the shroud 110.

Given the disclosure of the present invention, one versed in the art would appreciate that there may be other embodiments and modifications within the scope and spirit of the present invention. Accordingly, all modifications and equivalents attainable by one versed in the art from the present disclosure within the scope and spirit of the present invention are to be included as further embodiments of the present invention. The scope of the present invention accordingly is to be defined as set forth in the appended claims.

What is claimed is:

1. An apparatus for generating high pressure comprising:

a receiver having a combustion chamber for holding a propellant, which produces a gas component and a particle component when the propellant undergoes an exothermic chemical reaction, and a flow passageway positioned downstream of the combustion chamber;

an ignition mechanism for causing the propellant in the chamber to undergo the exothermic chemical reaction; and a separator for substantially separating the particle component from the gas component in the flow passageway;

wherein the separator includes at least a first set of spirally or cyclonically curved fins for swirling and applying a centrifugal force on the gas and particle components;

wherein the separator further includes a plurality of annular pockets formed around the periphery of the flow passageway for trapping the particle component; and wherein the separator further includes a second set of spirally or cyclonically curved fins spaced from and positioned downstream of the first set of fins, and an intermediary planar member connecting the first and second sets of fins and substantially dividing the flow passageway extending between the first and second set of fins into two zones.

2. An apparatus for generating high pressure gas according to claim 1, wherein the propellant is composed of a slurry of aluminum powder and water, and wherein the exothermic chemical reaction produces hydrogen gas and aluminum oxide particles.

3. An apparatus for generating high pressure gas according to claim 1, wherein the separator includes at least one gas passageway having a length sufficient to allow the gas component to stay in front of the particle component and move out of the separator, and deflecting the particle component to substantially remain inside the separator.

4. An electrothermal gun comprising;

a receiver having a combustion chamber for holding a propellant, which produces a gas component and a particle component when the propellant undergoes an exothermic chemical reaction, and a flow passageway positioned downstream of the combustion chamber;

an ignition mechanism for causing the propellant in the combustion chamber to undergo the exothermic chemical reaction;

a separator for substantially separating the particle component from the gas component in the flow passageway; and a barrel connected to the receiver and communicating with the flow passageway;

wherein the separator includes at least a first set of spirally or cyclonically curved fins for swirling and applying a centrifugal force on the gas and particle components.

5. An electrothermal gun according to claim 4, wherein the propellant is composed of a slurry of aluminum powder and water, and wherein the exothermic chemical reaction produces hydrogen gas and aluminum oxide particles.

6. An electrothermal gun according to claim 4, wherein the separator includes at least one gas passageway having a length sufficient to allow the gas component to stay in front of the particle component and move out of the separator, and deflecting the particle component to substantially remain inside the separator.

7. An electrothermal gun according to claim 4, wherein the separator further includes a plurality of annular pockets formed around the periphery of the flow passageway for trapping the particle component.

8. An electrothermal gun according to claim 7, wherein the first set of fins extend substantially the entire axial length of the flow passageway.

9. An electrothermal gun according to claim 8, wherein the separator further includes a shroud that extends around the outer periphery of the fins at a distal end thereof to form a plurality of discrete flow paths, one for each adjacent pairs of fins.

10. An electrothermal gun according to claim 7, wherein the separator further includes a second set of spirally or cyclonically curved fins spaced from and positioned downstream of the first set of fins, and an intermediary planar member connecting the first and second sets of fins and substantially dividing the flow passageway extending between the first and second set of fins into two zones.

* * * * *